US005417571A

United States Patent [19]

Kvalseth

[11] Patent Number: 5,417,571

[45] Date of Patent: May 23, 1995

[54] CHILD RESISTANT LIGHTER

[76] Inventor: Tarald O. Kvalseth, 108 Turnpike Rd., Golden Valley, Minn. 55416

[21] Appl. No.: 239,761

[22] Filed: May 9, 1994

[51] Int. Cl.[6] ..... F23D 11/36

[52] U.S. Cl. ..... 431/153; 431/255; 431/277

[58] Field of Search ..... 431/153, 276, 277, 255, 431/150

[56] References Cited

U.S. PATENT DOCUMENTS 3,055,201 9/1962 Smith ..... 431/150
3,357,211 12/1967 Heri ..... 431/150
3,898,031 8/1975 Rasakowicz .
3,938,943 2/1976 Malamoud .
4,569,654 2/1986 Borghesi .
4,717,335 1/1988 Loveless .
4,758,152 7/1988 Kordecki .
4,784,601 11/1988 Nitta .
4,784,602 11/1988 Nitta .
4,786,248 11/1988 Nitta .
4,799,877 1/1989 Bisbee .
4,822,276 4/1989 Bisbee .
4,830,603 5/1989 Cirami .
4,832,596 5/1989 Morris, Sr. .
4,850,854 7/1989 Buck .
4,869,663 9/1989 Fremund .
4,904,180 2/1990 Nitta .
4,921,420 5/1990 Johnston .
5,002,482 3/1991 Fairbanks et al. .
5,074,781 12/1994 Fujita .

*Primary Examiner*—Carroll B. Dority
*Attorney, Agent, or Firm*—Palmatier, Sjoquist & Helget

[57] ABSTRACT

A child resistant cigarette lighter is disclosed. The lighter has a housing with a top end and a lower portion, the lower portion having a fuel reservoir. Positioned on the top end is a fuel nozzle connected to the reservoir through a valve. Located at the top end on one side of the nozzle is a valve actuator. Opposite the valve actuator with respect to the nozzle is a spark producing wheel and flint. The positioning of the contact surface of the valve actuator opposite the sparking wheel requires the use of two hands and a certain level of manual dexterity to ignite a flame. These requirements make the lighter very difficult for children to operate.

15 Claims, 2 Drawing Sheets

CHILD RESISTANT LIGHTER

BACKGROUND OF THE INVENTION

This invention relates to safety features for cigarette lighters fueled by compressed or liquified gas.

Disposable and refillable butane lighters have caused numerous deaths, personal injuries, and extensive property damage due to the fact that such lighters have been so designed that small children have been capable of igniting them. The typical gas butane lighter has a reservoir connected to a valve and nozzle on one side of the lighter, a spark producing wheel mounted substantially in the middle portion of the top of the lighter and a valve actuator mounted on an opposite side adjacent to the spark producing wheel. A flame is created by rotating the spark producing wheel and immediately or simultaneously depressing the valve actuator. This may be accomplished by children, either intentionally or inadvertently such as when the sparking wheel is rolled on a surface to generate sparks.

An alternate design of a butane lighter utilizes a piezoelectric sparking circuit which is activated as the valve actuation lever is depressed. These lighters are also susceptible to misuse by children in that the ignition occurs by the simple depression of a single lever or push button.

Several U.S. patents disclose safety features for these types of lighters. U.S. Pat. Nos. 4,784,601 and 4,784,602 to Nitta disclose slidable stoppers that prevent the depression of the "thumb push gas lever" when the stoppers are in the obstructing position.

U.S. Pat. No. 4,758,152 to Kordecki discloses a pivotal bar that pivots to obstruct the depression of the gas lever.

U.S. Pat. No. 4,786,248 discloses a thumb latch that operates to prevent depression of the thumb pusher of a piezoelectric lighter. U.S. Pat. No. 4,832,596 also discloses a stop member slidably mounted on a conventional disposable butane lighter for releasing the gas actuating lever.

The devices described in the above patents all utilize some type of safety latch or member to obstruct or prevent depression of the valve actuator lever. A disadvantage of most of these lighters is that said devices allow the lighters to be placed in an "unlocked" or operational mode immediately after ignition. A user may, in essence, cock the lighters after use to be ready for the next use. In such a situation the lighter effectively becomes a conventional lighter without the child resistant feature.

SUMMARY OF THE INVENTION

A child resistant cigarette lighter is disclosed. The lighter has a housing with a top end and a lower portion, the lower portion having a fuel reservoir. Positioned on the top end is a fuel nozzle connected to the reservoir through a valve. Located at the top end on one side of the nozzle is a valve actuator. Opposite the valve actuator with respect to the nozzle is a spark producing wheel and flint. The positioning of the contact surface of the valve actuator opposite the sparking wheel requires the use of two hands and a certain level of manual dexterity to ignite a flame. These requirements make the lighter very difficult for children to operate.

An advantage and object of the invention is to provide a simple lighter design that provides a high level of child resistance. The simple design minimizes manufacturing costs and maintains a high degree of reliability.

An additional object and advantage is that the invention is suitable for both piezoelectric lighters and lighters with sparking wheels.

An additional object and advantage of the invention is to provide a design that may be incorporated with other safety features.

DETAILED DESCRIPTION OF THE PREFERRED EMBODIMENTS

Figure 1:
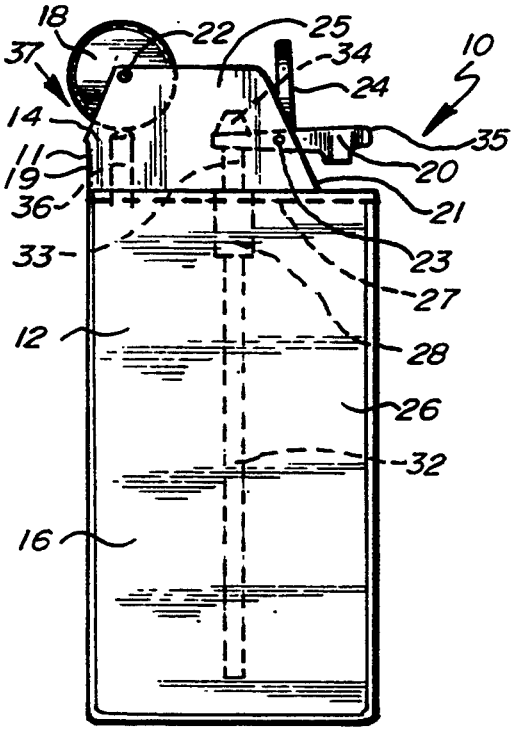
FIG. 1 shows an elevational view of a lighter incorporating the invention.

Referring to the figures, three different embodiments of the present invention are shown. Referring specifically to FIG. 1, an elevational view of a child resistant lighter is shown and is generally indicated by the numeral 10. The lighter 10 comprises a housing 12 with a top end 14 and a lower portion 16. The top end 14 may be formed of stamped metal and provides support for a sparking wheel 18 positioned on a first side 19 of the lighter 10 and the valve actuator 20 on the second side 21. The valve actuator 20 and sparking wheel 18 are attached at pivots 22 and 23 respectively. The valve actuator 20 is configured as a lever with an upright guard member 24 which may be utilized to provide additional isolation of the thumb from the flame. A windscreen 25 may be formed from the stamped metal comprising the top end 14. The lower portion 16 of the lighter 10 may be molded from a polycarbonate plastic.

The housing 12 has an open interior constituting a reservoir 26 for the lighter fuel. An appropriate fuel is butane. Positioned at the top 27 of the lower portion 16 and extending therefrom is a valve 28 which communicates with the reservoir 26 by way of the tube 32. Extending upwardly from the valve 28 is a valve stem 33 and a gas nozzle 34. The valve 28 is opened by raising the valve stem 33. The valve 28 has an internal bias urging the valve 28 to the closed position. Extending from the top 27 of the lower portion 16 is the flint 36 which engages the sparking wheel 18. The flint 36 and the sparking wheel 18 comprise an ignition means 37. In the preferred embodiments shown, the components comprising the valve 28, the sparking wheel 18, and the flint 36 are all conventional.

The embodiment of the invention shown in FIG. 1 operates as follows: Depression of the valve actuator 20 at the contact surface 35 raises the nozzle 34 and valve stem 33 in that the pivot point 23 operates as a fulcrum.

The raising of the valve stem 33 opens the valve 28 to release the fuel from the reservoir 26. Simultaneous with or after depression of the valve actuator 20, ignition is provided by rotation of the sparking wheel 18.

The separation of the valve actuator 20 from the sparking wheel 18 requires a significant amount of dexterity and manipulation in order to perform the two distinct actions to create a flame, that is, the opening of the valve 28 by depression of the valve actuator 20 and the production of a spark by rotation of the sparking wheel 18. Typically, this is a two-handed operation requiring a level of manual dexterity not present in very young children.

Figure 2:
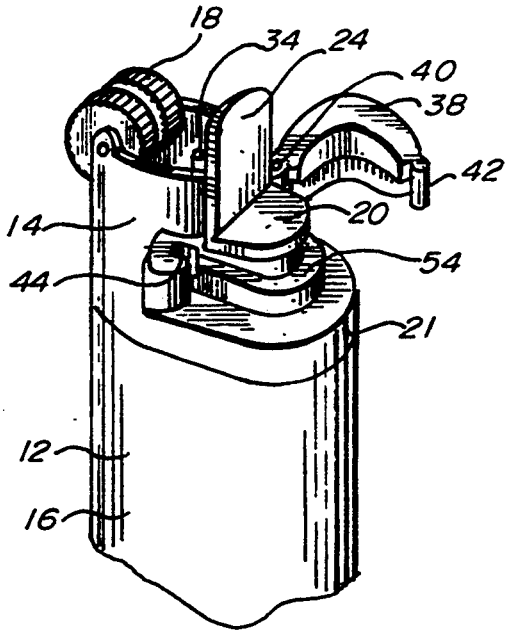
FIG. 2 shows a perspective view of a second embodiment of the invention.

Referring to FIG. 2, an alternate embodiment of the invention is shown with the same basic elements and further adding a pivoting latch or lock member 38 which is shown in an open or nonobstructing portion. The latch 38 is swingably attached to the top end 14 of the lighter 10 by way of hinge 40. The latch 38 swings around to engage with and seat on the ledge 54. The tab 42 engages the receptacle 44 to lock the latch 38 in an interference position. In such a position the valve actuator 20 is obstructed and cannot be depressed to open the valve. The lock member 38 is configured such that a significant amount of manual dexterity is necessary to release the pivoting latch 38. When released, the simultaneous operation of the valve actuator 20 and the sparking wheel 18 is a two handed operation.

Figure 3:
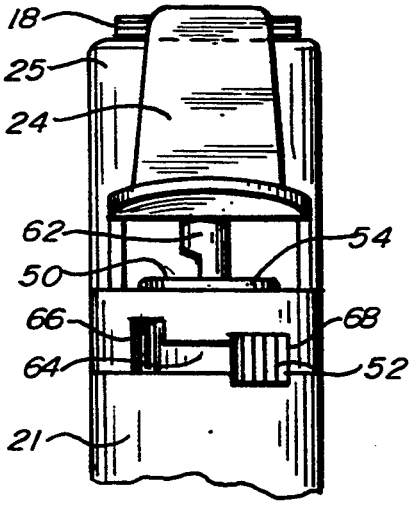
FIG. 3 shows a perspective view of the lock member utilized in the embodiment shown in FIGS. 4 and 5.
Figure 4:
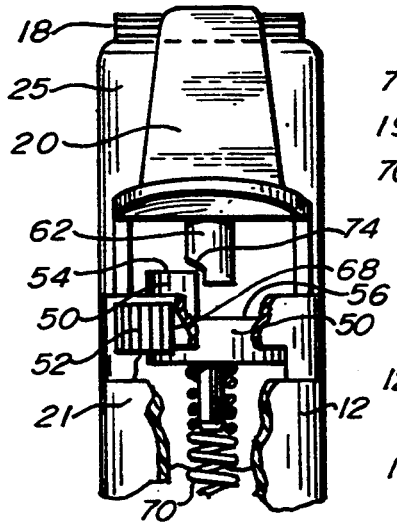
FIG. 4 shows an elevational view of the second side of an additional embodiment of the invention.
Figure 5:
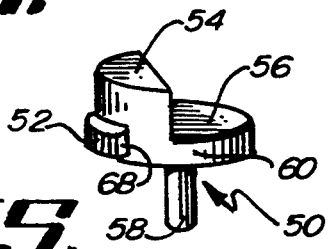
FIG. 5 shows the same view as FIG. 4 with a portion of the housing cut away.

Referring to FIGS. 3, 4, and 5, an alternate embodiment of the invention is shown also utilizing a latch or lock member 50 to prevent the depression of the valve actuator 20. FIG. 5 shows a detail of the lock member which is generally denoted by the numeral 50. The lock member 50 has a knurled knob 52 with a detent surface 68, an obstructing portion 54 and a lower surface 56. A shaft 58 extends downwardly from the cylindrical shaped body 60.

Referring to FIG. 3, the valve actuator 20 has a tab 62 extending downward to engage the lock member 50. In the obstructing or locked position as shown in FIG. 3, the obstructing portion 54 interferes with the tab 62 to prevent the depression of the valve actuator 20. The lock member 50 can pivot or rotate within the housing 12 of the lighter 10 as permitted by engagement of the knob 52 with a slot 64. A detent 66 in the slot 64 is positioned for engagement by a detent surface 68 on the knob 52 to hold the lock member 50 in the unobstructed position in preparation for ignition.

Referring to FIG. 4, the same embodiment of FIG. 3 is shown in the unobstructed or operating position. A portion of the housing 12 is cut away to reveal the latch or lock member 50 and related mechanisms. An upward and counterclockwise bias is provided to the lock member 50 by way of a spring 70. In this view the knurled knob 52 and the lock member 50 are shown latched in the unobstructed or operating position. The obstructing portion 54 has been rotated out of an obstructing or interference position with tab 62 to allow depression of the valve actuator 20.

The embodiment of the invention shown in FIGS. 3 and 4 operates as follows: The knurled knob 52 is manually moved in the slot 64 from the position shown in FIG. 3 to the detent 66 shown in FIG. 4. The valve actuator 20 must then be depressed as the sparking wheel 18 is rotated for ignition to occur. This generally is a two handed operation requiring more manual dexterity than that possessed by small children. The valve actuator 20 must be held down after ignition to maintain the flame. As the valve actuator 20 is depressed, the tab 62 engages the lower surface 56 of the lock member 50 to release the detent surface 68 of the knurled knob 52 from the detent 66 which allows the spring bias to rotate the lock member 50 counterclockwise. An inclined surface 74 of the tab 62 aids in the disengagement of the knurled knob 52 from the detent 66 and further allows partial rotation of the lock member 50 as the valve actuator 20 is being released from the depressed position. When the lock member 50 rotates back to the obstructing position, as shown in FIG. 3, the valve actuator 20 cannot be depressed.

Figure 6:
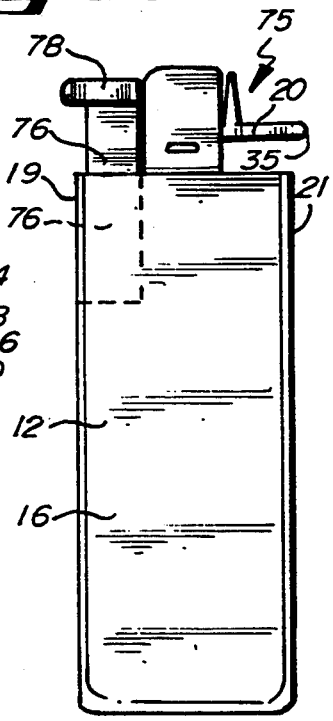
FIG. 6 shows an elevational view of a piezoelectric lighter incorporating the invention.

Referring to FIG. 6, a piezoelectric lighter is shown which incorporates the invention and is designated by the numeral 75. The lighter 75 has a conventional piezoelectric sparking unit 76 as the ignition means and a push button 78 for a manual activation member. The piezoelectric lighter has a conventional valve, not shown, and a valve actuator 20 similar to that shown in the other embodiments. The valve actuator 20 is held down as the push button 78 is depressed for ignition. This is generally a two-handed operation and it is difficult for young children to properly coordinate these actions.

Figure 7:
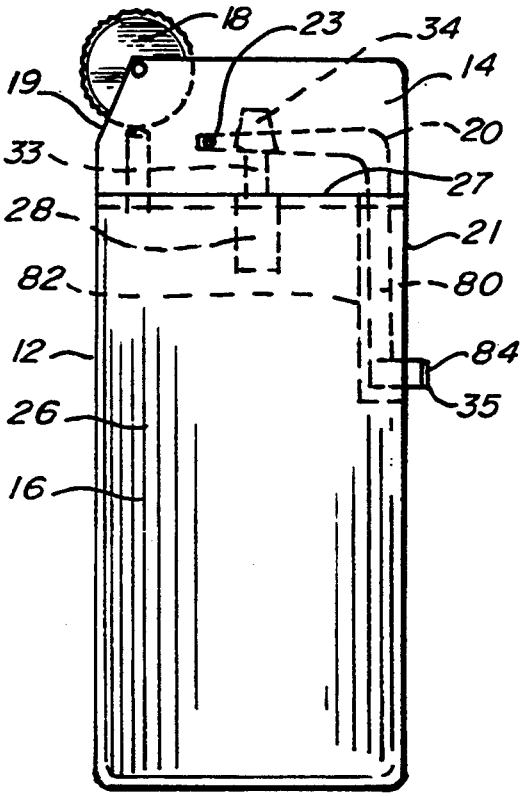
FIG. 7 shows an elevational view of an additional embodiment of the invention.
Figure 8:
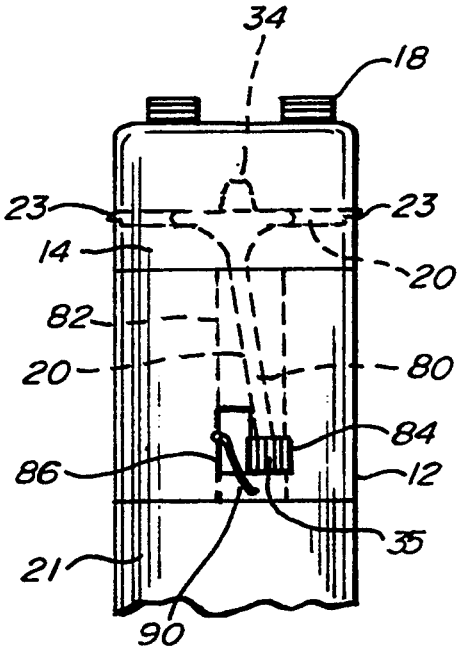
FIG. 8 shows an elevational view of the second side of the embodiment of FIG. 7.
Figure 9:
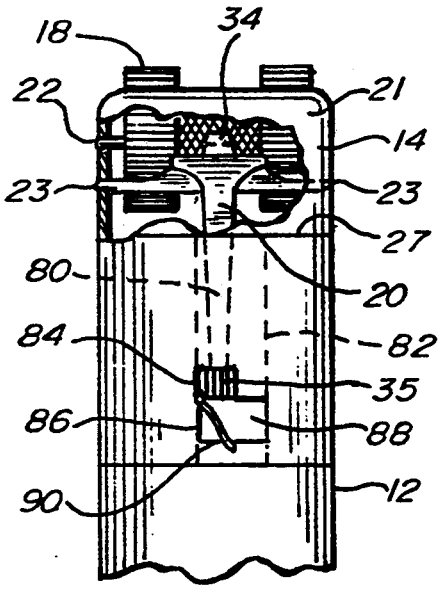
FIG. 9 shows the same view as FIG. 8 with the valve actuator in the open position.

Referring to FIGS. 7, 8 and 9, an additional embodiment of the invention is shown. FIGS. 7 and 8 show this embodiment with the valve actuator 20 in the nonoperable or closed position. FIG. 9 shows the valve actuator 20 raised to the open or operating position. This embodiment has pivot points 23 positioned opposite the valve actuator 20 with respect to the valve 28. This mandates an upward vertical motion on the valve actuator 20 to open the valve 28. The valve actuator 20 is generally L-shaped, has a lower arm 80 that extends downward through a cavity 82 in the housing 12, and has a knob 84 with a contact surface 35 which is engaged within an L-shaped slot 86 in the housing. The slot has a detent 88 for retaining the knob 84 and consequently the valve actuator 20 in a locked position. A spring 90 provides the bias to retain the knob 84 in the detent 88 until the bias of the spring 90 is overcome. The bias to retain the valve actuator 20 in the locked position may also be provided by resiliency in the lower arm 80 of the valve actuator 20. This embodiment can be modified so that the cavity functions to guide and constrain the valve actuator, whereby the pivot points 23 are not utilized.

This embodiment operates as follows: The knob 84 is moved laterally from the downward closed position shown in FIG. 8 and then vertically upward to the upward open position shown in FIG. 9. This raises the valve actuator 20, the nozzle 34, and the valve stem 33, which results in the opening of the valve 28. The sparking wheel 18 is then rotated to cause ignition. The flame is sustained by continuing to provide upward force to the valve actuator 20. Upon release of the valve actuator 20, it returns to the locked, nonoperable position in the detent 88 shown in FIG. 8. Downward vertical bias of the valve actuator 20 is provided by the valve, not shown in this embodiment. If desired, this bias may be supplemented or replaced by a suitable spring external to the valve.

In addition to the safety latching or locking features shown in FIGS. 2–9, it is anticipated and recognized that various other safety features that exist or may be developed in the future also may be utilized with or incorporated into the invention. Moreover, the embodiments of the lighters described above are suitable for both disposable and refillable lighters.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A child resistant cigarette lighter comprising:

a) a housing having a top end and a lower portion, the top end having a first side and an opposite second side, the lower portion containing a gas reservoir;

b) a gas nozzle affixed to the top end of the housing, the gas nozzle communicable with the gas reservoir;

c) a valve inserted intermediate the gas nozzle and the reservoir whereby the communication between the reservoir and gas nozzle is controlled by said valve;

d) a valve actuator attached to the valve at one end for opening and closing said valve, the valve actuator extending to another end adjacent to and above the first side, the valve actuator having an open position and a closed position; the space above the valve actuator at said first side being clear so that a users thumb may engage said actuator to force the actuator to an open position;

e) an ignition means attached to the top end, the ignition means comprising a manual activation member, the manual activation member positioned on the second side opposite to the valve actuator; and the valve actuator being pivotally mounted on said top end on an opposite side of said gas nozzle from said ignition means.

2. The lighter of claim 1 further comprising a windscreen attached to the top end and extending around the nozzle.

3. The lighter of claim 1, wherein the ignition means further comprises a spark wheel rotatably mounted to the top end of the housing, and a flint engaging said spark producing wheel.

4. The lighter of claim 1, wherein the ignition means further comprises a piezoelectric sparking unit and the manual activation member comprises a push button.

5. The lighter of claim 3 further comprising a latch attached to the top end, the latch having an obstructing position and an operating position, whereby in the obstructing position the valve actuator is obstructed from moving to the open position.

6. A child resistant cigarette lighter comprising:

a) a housing having a top end and a lower portion, a first side, and an opposite second side, the lower portion containing a fuel reservoir;

b) a nozzle affixed to the top end intermediate of the first side and the second side;

c) a valve inserted between the nozzle and the fuel reservoir, the valve having a valve actuator with a contact surface, the valve operable to control the fuel flow between the reservoir and the nozzle, the contact surface of the valve actuator positioned at the second side and being configured as a lever extending substantially horizontally from the valve, the lever being pivotally attached to the housing and the space above the lever being clear so that a users thumb may engage said lever whereby depression of the lever opens to valve; and d) manually engaged ignition means positioned at the first side.

7. The lighter of claim 6, wherein the valve actuator further comprises an upright member.

8. The lighter of claim 6 further comprising a lock member pivotally attached to the top end to pivot between an interference position and an operating position relative to the valve lever, whereby in the interference position the lock member prevents the depression of the valve lever.

9. The lighter of claim 8, wherein the locking member is biased to the interference position and the lighter further comprises a detent to releasably engage the locking member in the operating position.

10. The lighter of claim 6, wherein the housing wraps around the nozzle to form a windscreen about the nozzle.

11. The lighter of claim 9 further comprising a tab connected to the valve lever, and positioned to engage the lock member as the valve actuator is depressed whereby the locking member is released from the detent.

12. A cigarette lighter comprising:

a) a housing having two sides and a lower portion with a top;

b) a fuel reservoir within the housing;

c) a nozzle extending from the top and connected to the fuel reservoir;

d) a valve intermediate the reservoir and the nozzle to control communication from the reservoir to the nozzle, the valve having an upward open position and a downward closed position, the valve biased towards the closed position;

e) a valve actuator having a contact surface extending through an opening in said housing the valve actuator connected to the valve to open and close said valve, the contact surface located on a side of the housing, means for pivotally mounting the valve actuator, and the valve actuator moveable upwardly whereby the valve is opened; and f) a manual ignition activation member attached to the top, the ignition activation member positioned at a side opposite the contact surface of the valve actuator with respect to the nozzle.

13. The lighter of claim 12, wherein the contact surface of the valve actuator is positioned below the top of the lower portion.

14. The lighter of claim 13, wherein the valve actuator is generally L-shaped and extends downwardly in the lower portion of the housing.

15. The lighter of claim 13 further including means forming a detent engageable with the valve actuator to lock the valve actuator in a nonoperating position.

* * * * *